US006320144B1

(12) United States Patent
Inomata

(10) Patent No.: US 6,320,144 B1
(45) Date of Patent: Nov. 20, 2001

(54) COAXIAL CONNECTOR SWITCH

(75) Inventor: Yoji Inomata, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/606,803

(22) Filed: Jun. 29, 2000

(30) Foreign Application Priority Data

Jun. 30, 1999 (JP) ..... 11-186424

(51) Int. Cl.[7] ..... H01R 33/96
(52) U.S. Cl. ..... 200/51.1
(58) Field of Search ..... 200/51.09, 51.1; 439/188

(56) References Cited

U.S. PATENT DOCUMENTS 5,625,177 * 4/1997 Yukinori et al. ..... 200/51.09 X
6,030,240 * 2/2000 Duff ..... 439/188
6,099,334 * 8/2000 Togashi ..... 439/188
6,142,803 * 11/2000 Bozzer et al. ..... 439/188

FOREIGN PATENT DOCUMENTS

0924810 A2 6/1999 (EP) .
2307113 A 5/1997 (GB) .

* cited by examiner

*Primary Examiner*—J. R. Scott
(74) *Attorney, Agent, or Firm*—Pearne & Gordon LLP

(57) ABSTRACT

A cover plate is attached to a switch portion of a coaxial connector. With this construction, even when the rising of flux due to surface tension occurs during a surface-mounting operation by reflow soldering, the flux is prevented from reaching the switch portion, thus preventing a disadvantage that the contact resistance is increased by the flux.

9 Claims, 3 Drawing Sheets

COAXIAL CONNECTOR SWITCH

BACKGROUND OF THE INVENTION

1. Field of the Invention

This invention relates to a coaxial connector switch, and more particularly to such a switch in which a cover plate is attached to a switch portion of a coaxial connector so as to prevent the increase of a contact resistance of the switch portion of the coaxial connector due to the intrusion of flux and also to prevent the intrusion of dust.

2. Description of the Related Art

There has been extensively used a coaxial connector switch which is connected to an antenna on an automobile via a coaxial adapter, connected to the automobile antenna, so that the automobile antenna can be used as an antenna of a portable cellular telephone.

FIG. 3 is a bottom view showing the construction of a conventional coaxial connector switch. FIG. 4 is a cross-sectional view taken along the line 4—4 of FIG. 3, showing the construction of the conventional coaxial connector switch.

The construction of the conventional coaxial connector switch will now be described with reference to FIGS. 3 and 4. In FIG. 4, a dielectric member 21, in which a center pin 23 is inserted, is fitted on a funnel-shaped outer conductor 24. The center pin 23 is held in contact with a first contact leg 26, including a resilient contact arm 25 having a contact projection, and the center pin 23 is urged upward by a resilient force of the first contact leg 26.

The first contact leg 26 is contacted at its contact projection with a second contact leg 27 so that a signal can be fed from the first contact leg 26 to the second contact leg 27. When the center pin 23 is pushed by a coaxial adapter 40, the signal can be fed from the first contact leg 26 to the center pin 23. This will be described later.

Although not shown in FIG. 4, a terminal 28 of the first contact leg 26 and a terminal 29 of the second contact leg 27 are mounted (surface mounted) by reflow soldering on a conductor on a surface of a printed circuit board. Also, first and second terminals 31 and 32 (shown in FIG. 3), formed on the outer conductor 24, are mounted (surface mounted) on the conductor of the printed circuit board by reflow soldering.

Next, the operation of the conventional axial connector switch will be described with reference to FIG. 5. In FIG. 5, the coaxial adapter 40 is pushed into the coaxial connector switch in a direction of an arrow, a central conductor 41 abuts against the center pin 21 to push the same downward. As a result, the center pin 21 is moved downward against the bias of the first contact leg 26, so that the flow of the signal from the first contact leg 26 to the second contact leg 27 is interrupted.

At this time, an outer conductor 42 surrounding dielectric portion 43 of the coaxial adapter 40 is brought into contact with the outer conductor 24 of the coaxial connector switch, so that signals from the terminals 31 and 32, formed on the outer conductor 24 of the coaxial connector switch, are connected to the outer conductor 42 of the coaxial adapter 40, and also the signal from the first contact leg 26 of the coaxial connector.

As a result, the flow of the signal from the first contact leg 26 is switched to the central conductor 41 of the coaxial adapter 40, and therefore the automobile antenna can be used as an antenna of the portable cellular telephone.

In the above conventional coaxial connector switch, however, a cover plate is not provided at the switch portion of the coaxial connector; therefore, the rising of flux due to surface tension during the surface-mounting operation by the reflow soldering can not be prevented, so that the contact resistance is increased by the flux, and in the worst case, there has been encountered a disadvantage that the switch portion has failed to function as a switch.

SUMMARY OF THE INVENTION

This invention seeks to solve the above problem, and an object of the invention is to provide a coaxial connector switch in which the rising of flux during the surface-mounting operation by reflow soldering is prevented so that the contact resistance of the switch will not be increased by the flux.

According to the first aspect of the invention, there is provided a coaxial connector switch wherein a dielectric member, in which a center pin is inserted, is fitted on a funnel-shaped outer conductor, and the center pin is usually urged upward by a resilient arm, forming a switch; characterized in that a cover plate is attached to a switch portion of a coaxial connector so as to prevent the increase of a contact resistance of the switch portion of the coaxial connector due to the intrusion of flux. There is achieved an advantage that the contact resistance of the switch will not be increased by the flux.

According to the second aspect of the invention, there is provided a coaxial connector switch wherein a center pin is inserted, is fitted on a funnel-shaped outer conductor, and the center pin is usually urged upward by a resilient arm, forming a switch; characterized in that a cover plate is closely attached to a switch portion of a coaxial connector so as to prevent the intrusion of dust into the switch portion of the coaxial connector. There are achieved advantages that dust will not intrude into the switch portion from the exterior and that the corrosion of switch contacts is prevented.

According to the third aspect of the invention, the coaxial connector switch is characterized in that cover plate is formed by the same material as that of the dielectric member. There is achieved an advantage that the cover plate can be formed by the same material as that of the dielectric member.

According to the fourth aspect of the invention, the cover plate of the coaxial connector switch has a portion corresponding to the switch portion, which is smaller in thickness than a portion corresponding to terminal portions.

According to the fifth aspect of the invention, and the coaxial connector switch is characterized in that a bottom end of the center pin is pointed. There is achieved an advantage that a load per unit area can be increased; therefore, a first contact leg can be held in contact with the center pin without increasing the resilient force of the first contact leg.

DETAILED DESCRIPTION OF THE PREFERRED EMBODIMENTS

A preferred embodiment of the present invention will now be described with reference to FIGS. 1 and 2.

Figure 1:
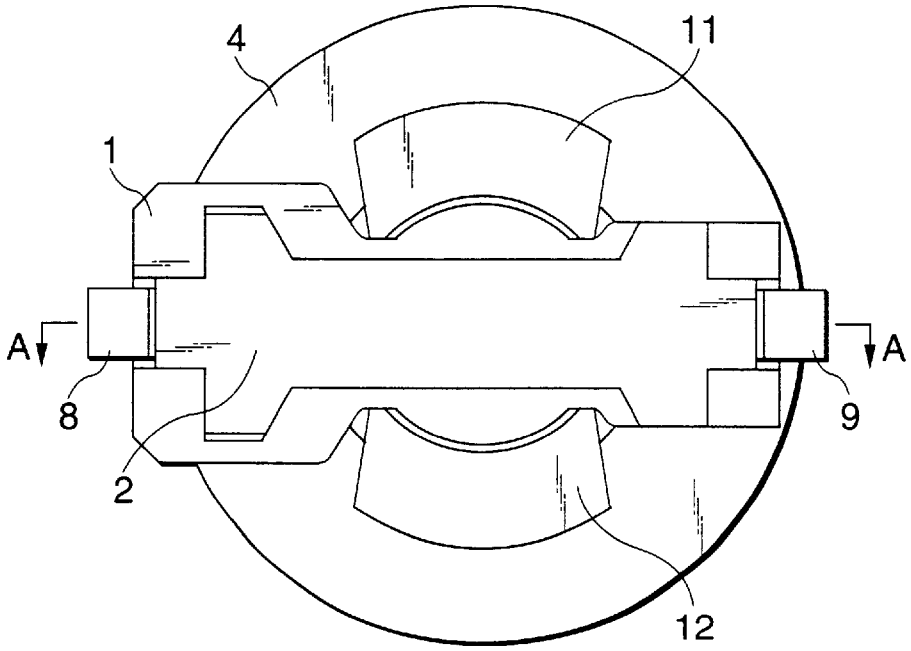
FIG. 1 is a bottom view showing the construction of a preferred embodiment of a coaxial connector switch of the invention.

FIG. 1 is a bottom view showing the construction of an embodiment of a coaxial connector switch of the invention. FIG. 2 is a cross-sectional view taken along the line A—A of FIG. 1, showing the construction of the coaxial connector switch of this embodiment.

The construction of the coaxial connector switch of this embodiment will now be described with reference to FIGS. 1 and 2. In FIG. 2, a dielectric member 1, in which a center pin 3 is inserted, is fitted on a funnel-shaped outer conductor 4. The center pin 3 is held in contact with a first contact leg 6, including a resilient contact arm 5, and the center pin 3 is urged upward by a resilient force of the first contact leg 6.

Figure 5:
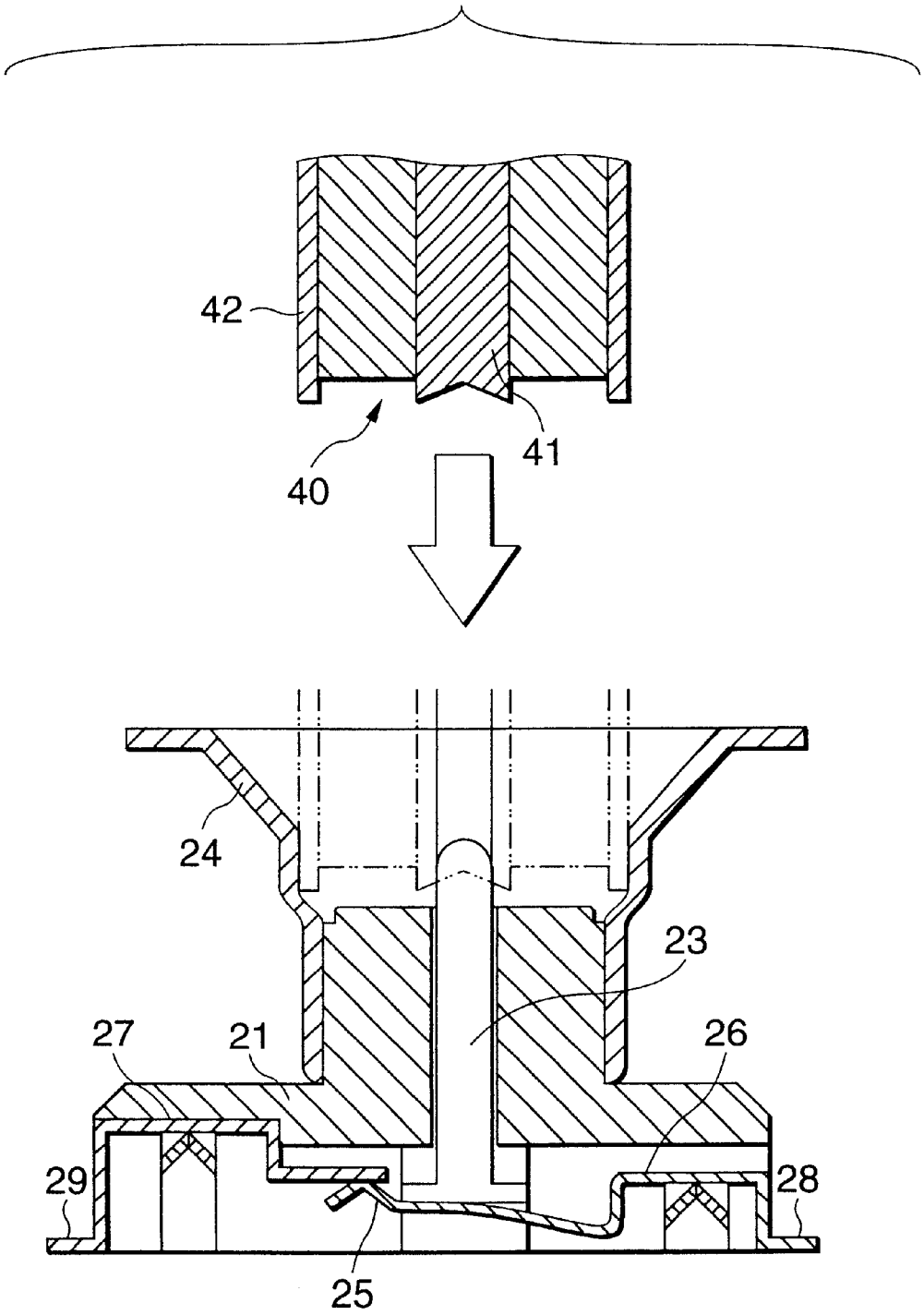
FIG.5 PRIOR ART
FIG. 5 is a cross-sectional view showing the operation of the conventional coaxial connector switch.

The first contact leg 6 has a flat distal end portion which is contacted with a second contact leg 7 by the resilient force of the first contact leg 6 so that a signal can be fed from the first contact leg 6 to the second contact leg 7. When the center pin 3 is pushed by a coaxial adapter 40 of the same construction as described above, the signal can be fed from the first contact leg 6 to the center pin 3. This operation is the same as described above for FIG. 5, and therefore explanation thereof will be omitted here.

Figure 2:
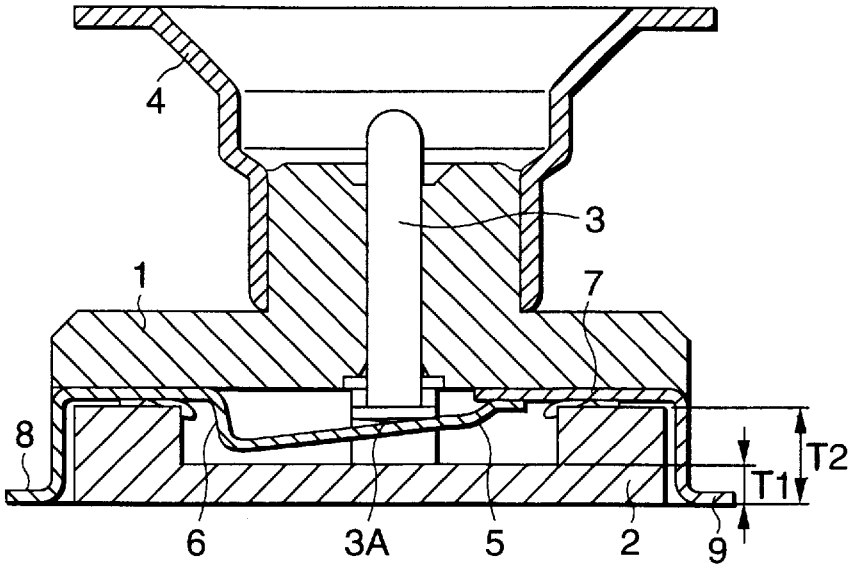
FIG. 2 is a cross-sectional view taken along the line 2—2 of FIG. 1, showing the construction of the coaxial connector switch of the invention.

Although not shown in FIG. 2, a terminal 8 of the first contact leg 6 and a terminal 9 of the second contact leg 7 are mounted (surface mounted) by reflow soldering on a conductor on a surface of a printed circuit board. Also, first and second terminals 11 and 12 (shown in FIG. 1), formed on the outer conductor 4, are mounted (surface mounted) on the conductor of the printed circuit board by reflow soldering.

Figure 3:
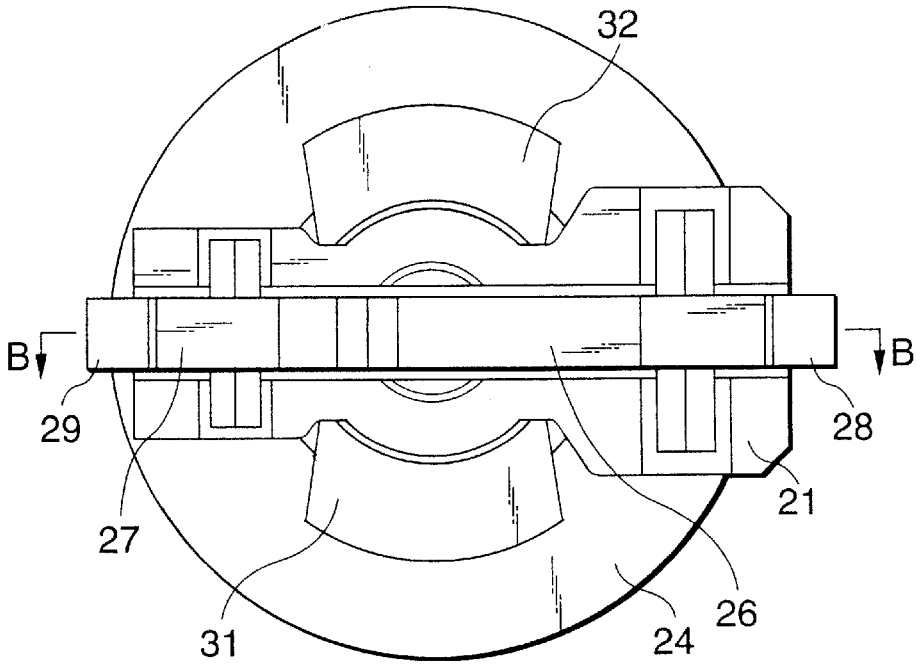
FIG.3 PRIOR ART
FIG. 3 is a bottom view showing the construction of a conventional coaxial connector switch.
Figure 4:
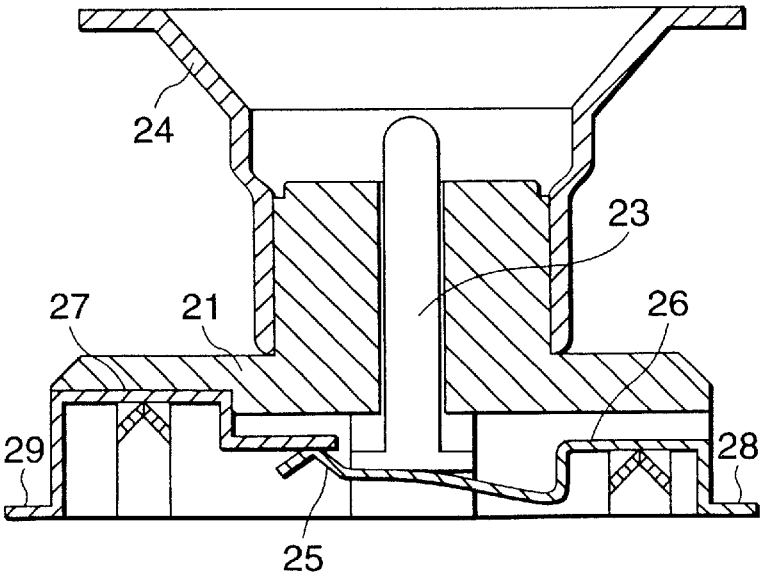
FIG.4 PRIOR ART
FIG. 4 is a cross-sectional view taken along the line 4—4 of FIG. 3, showing the construction of the conventional coaxial connector switch.

In the conventional construction of FIGS. 3 and 4, a cover plate is not provided at the switch portion of the coaxial connector; therefore, the rising of flux due to surface tension during the surface-mounting operation by the reflow soldering can not be prevented, so that the contact resistance is increased by the flux, and in the worst case, there has been encountered a disadvantage that the switch portion has failed to function as a switch. In this embodiment, however, a cover plate 2 is attached to the switch portion of the coaxial connector as shown in FIGS. 1 and 2; therefore, the above disadvantage can be prevented. In addition, a coaxial connector switch of this embodiment, the cover plate is formed by the same material as that of the dielectric member. In the cover plate, thickness T1 corresponding to the switch portion, is smaller than thickness T2 corresponding to each terminal portion of the coaxial connector.

As shown in FIGS. 1 and 2, the cover plate 2 is closely attached to the switch portion of the coaxial connector; therefore, the switch portion is not exposed to the exterior in contrast with the conventional construction. Therefore, dust will not intrude into the switch portion from the exterior, and besides the corrosion of the switch contacts can be prevented.

As shown in FIG. 2, the bottom end 3A of the center pin 3 is pointed, and with this construction a load per unit area can be increased; therefore, the first contact leg 6 can be held in contact with the center pin 3 without the need for increasing the resilient force of the first contact leg 6.

As described above, in the coaxial connector switch of the invention, the dielectric member, in which the center pin is inserted, is fitted on the funnel-shaped outer conductor, and the center pin is usually urged upward by the resilient arm, forming the switch, and this coaxial connector switch is characterized in that the cover plate is attached to the switch portion of the coaxial connector so as to prevent the increase of the contact resistance of the switch portion of the coaxial connector due to the intrusion of flux.

With this construction, there can be obtained the coaxial connector switch in which the increase of the contact resistance of the switch portion of the coaxial connector due to the intrusion of flux is prevented.

While only a certain embodiment of the invention has been specifically described herein, it will be apparent that numerous modifications may be made thereto without departing from the spirit and scope of the invention.

The present invention is based on Japanese Patent Application No. Hei. 11-186424 which is incorporated herein by reference.

What is claimed is:

1. A coaxial connector switch comprising:

a funnel-shaped conductor;

a dielectric member fitted on said funnel-shaped conductor;

a center pin inserted into said dielectric member;

a resilient arm capable of contacting with said center pin, so that a switch portion is composed of both said center pin and said resilient arm; and a cover plate attached to the switch portion.

2. The coaxial connector switch according to claim 1, wherein said cover plate is closely attached to the switch portion.

3. The coaxial connector switch according to claim 1, wherein said cover plate is formed by the same material as that of said dielectric member.

4. The coaxial connector switch according to claim 2, wherein said cover plate is formed by the same material as that of said dielectric member.

5. The coaxial connector switch according to claim 1, wherein said cover plate has a thin portion covering switch portion and smaller in thickness than a portion covering a terminal portion.

6. The coaxial connector switch according to claim 2, wherein said cover plate has a thin portion covering switch portion and smaller in thickness than a portion covering a terminal portion.

7. The coaxial connector switch according to claim 1, wherein a bottom end of said center pin is pointed.

8. The coaxial connector switch according to claim 2, wherein a bottom end of said center pin is pointed.

9. A coaxial connector switch comprising:

a funnel-shaped conductor;

a dielectric member fitted on said funnel-shaped conductor;

a center pin inserted into said dielectric member;

a resilient arm capable of contacting with said center pin, so that a switch portion is composed of both said center pin and said resilient arm;

a circuit board attached to the switch portion; and an insulator portion fitted over said switch portion and located between said switch portion and said circuit board.

* * * * *